US012692063B2

(12) United States Patent
Sato et al.

(10) Patent No.: US 12,692,063 B2
(45) Date of Patent: Jul. 28, 2026

(54) CUSHIONING MEMBER FOR PACKED OBJECT

(71) Applicant: SUZUKI MOTOR CORPORATION, Hamamatsu (JP)

(72) Inventors: Atsushi Sato, Hamamatsu (JP); Wataru Karasudani, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 19/018,916

(22) Filed: Jan. 13, 2025

(65) Prior Publication Data

US 2025/0296756 A1 Sep. 25, 2025

(30) Foreign Application Priority Data

Mar. 22, 2024 (JP) ..... 2024-046777

(51) Int. Cl.
*B65D 85/68* (2006.01)
*B65D 81/107* (2006.01)

(52) U.S. Cl.
CPC ..... *B65D 81/107* (2013.01); *B65D 85/68* (2013.01); *B65D 2581/053* (2013.01); *B65D 2581/055* (2013.01); *B65D 2585/6877* (2013.01)

(58) Field of Classification Search
USPC ..... 220/668; 206/320
See application file for complete search history.

(56) References Cited

U.S. PATENT DOCUMENTS

| | | | | |
|---|---|---|---|---|
| 5,339,958 | A | 8/1994 | Taravella et al. | 206/521 |
| 5,755,331 | A * | 5/1998 | Watson | B65D 81/05 206/320 |
| 6,186,330 | B1 * | 2/2001 | Yoshimura | B65D 5/5071 206/320 |
| 2012/0241351 | A1 | 9/2012 | Tsukii | 206/521 |

FOREIGN PATENT DOCUMENTS

| | | | | |
|---|---|---|---|---|
| DE | 102006046077 B3 * | 1/2008 | | B65D 81/07 |
| JP | H 10-250768 A | 9/1998 | | |
| JP | H 10-287371 A | 10/1998 | | |
| WO | WO-2019106869 A1 * | 6/2019 | | B65D 19/44 |

OTHER PUBLICATIONS

Extended European Search Report mailed Jul. 7, 2025, issued to counterpart European Application No. 25152707.3.

* cited by examiner

*Primary Examiner* — Mollie Impink
(74) *Attorney, Agent, or Firm* — Stein IP, LLC

(57) ABSTRACT

A cushioning member for protecting a packed object is disposed inside a side of a packing frame surrounding a packed object, the cushioning member being provided to protect the packed object secured on an inner bottom of the packing frame, the cushioning member including: a first cushioning member that has a front face disposed adjacent to the packed object and a back side opposite to the front face; and a second cushioning member that has an upper end in contact with the back side of the first cushioning member and a bottom disposed near the side of the packing frame, wherein the first cushioning member is made of a foam material, and the second cushioning member includes a corrugated board assembly.

8 Claims, 9 Drawing Sheets

CUSHIONING MEMBER FOR PACKED OBJECT

CROSS-REFERENCE TO RELATED APPLICATIONS

This application claims the benefit of Japanese Patent Application No. 2024-046777, filed on Mar. 22, 2024, in the Japanese Patent Office. All disclosures of the document named above are incorporated herein by reference.

TECHNICAL FIELD

The present invention relates to a cushioning member for protecting a packed object.

BACKGROUND ART

When industrial products or the like are transported to a remote destination (e.g., overseas) by using a shipping container or the like, a packing structure is adopted in which the products are secured in a packing frame to be protected from vibration and shocks during transportation.

For example, Patent Literature 1 discloses a packing structure in which an outboard motor placed horizontally is sandwiched between polystyrene foam pads from above and below and is secured on a wooden skid with square posts and angled paper tubes. This packing structure is aimed at lightweight and compact outboard motors, but is not usable for medium-sized or large-sized outboard motors. Furthermore, the packing structure is not strong enough to withstand multi-level stacking despite the flat packing shape, resulting in poor loading efficiency. In addition, the packing structure is based on a configuration that receives a load with a wide pad to distribute the load. This may lead to greater use of polystyrene foam, which will become industrial waste.

In the case of outboard motors, particularly medium-sized or larger outboard motors, a packing form is adopted in which an outboard motor in an upright position with its propulsion direction facing downwards is bolted and stored on a stand erected on the inner bottom of the packing frame, by using a stern bracket as a structure for securing the outboard motor to a hull.

In this packing form, no support structure is practically provided for the packing frame other than the stern bracket, and the outboard motor is supported inside the packing frame in an overhanging state on both sides of the stand. Moreover, the center of gravity is placed high relative to the support position and is biased toward the engine. Therefore, when an impact is applied due to an external factor during loading and unloading operations or transportation, the outboard motor, which is a packed object, may swing and come into contact with the packing frame. Thus, in order to avoid damage caused by contact, a cushioning material such as polystyrene foam is also used.

In addition, final products such as outboard motors are transported to a delivery destination in a packed state. Thus, the packing frame is basically a one-way packing material. In order to reduce additional cost, the packing frame is designed to have minimum strength and rigidity required for ordinary loading and unloading operations and transportation. For this reason, when a large impact occurs due to an external factor, in particular, the packing frame topples over, the cushioning material including polystyrene foam may fail to absorb the impact and may break, leading to damage to the outboard motor that is the packed object.

CITATION LIST

Patent Literature

[Patent Literature 1] JP H10-250768 A

SUMMARY OF INVENTION

Problem to be Solved by the Invention

The present invention has been devised in view of such circumstances. An object of the present invention is to provide a cushioning member for protecting a packed object, the cushioning member being designed to have an excellent cushioning effect with a small form and advantageously reduce industrial waste.

Means for Solving the Problem

In order to solve the problem, the present invention is a cushioning member disposed inside a side of a packing frame surrounding a packed object, the cushioning member being provided to protect the packed object secured on an inner bottom of the packing frame, the cushioning member comprising:

a first cushioning member that has a front face disposed adjacent to the packed object and a back side opposite to the front face; and a second cushioning member that has an upper end in contact with the back side of the first cushioning member and a bottom disposed near the side of the packing frame, wherein the first cushioning member comprises a foam material, and the second cushioning member comprises a corrugated board assembly.

Advantageous Effect of Invention

According to a thus configured cushioning member of the present invention, when a large impact is applied by an external factor, an impact load applied by the packed object to the cushioning member is reduced by elastic deformation of the first cushioning member made of a foam material and is absorbed by plastic deformation of the second cushioning member including a corrugated board assembly, and breakage of the first cushioning member, in particular, breakage in an initial stage, is reduced, thereby obtaining an excellent cushioning effect. Furthermore, as compared with a case in which a cushioning member is entirely made of a foam material, the present invention can reduce the amount of foam material used, which generates industrial waste after use.

MODE FOR CARRYING OUT THE INVENTION

Embodiments according to the present invention will be specifically described below with reference to the accompanying drawings.

Figure 1:
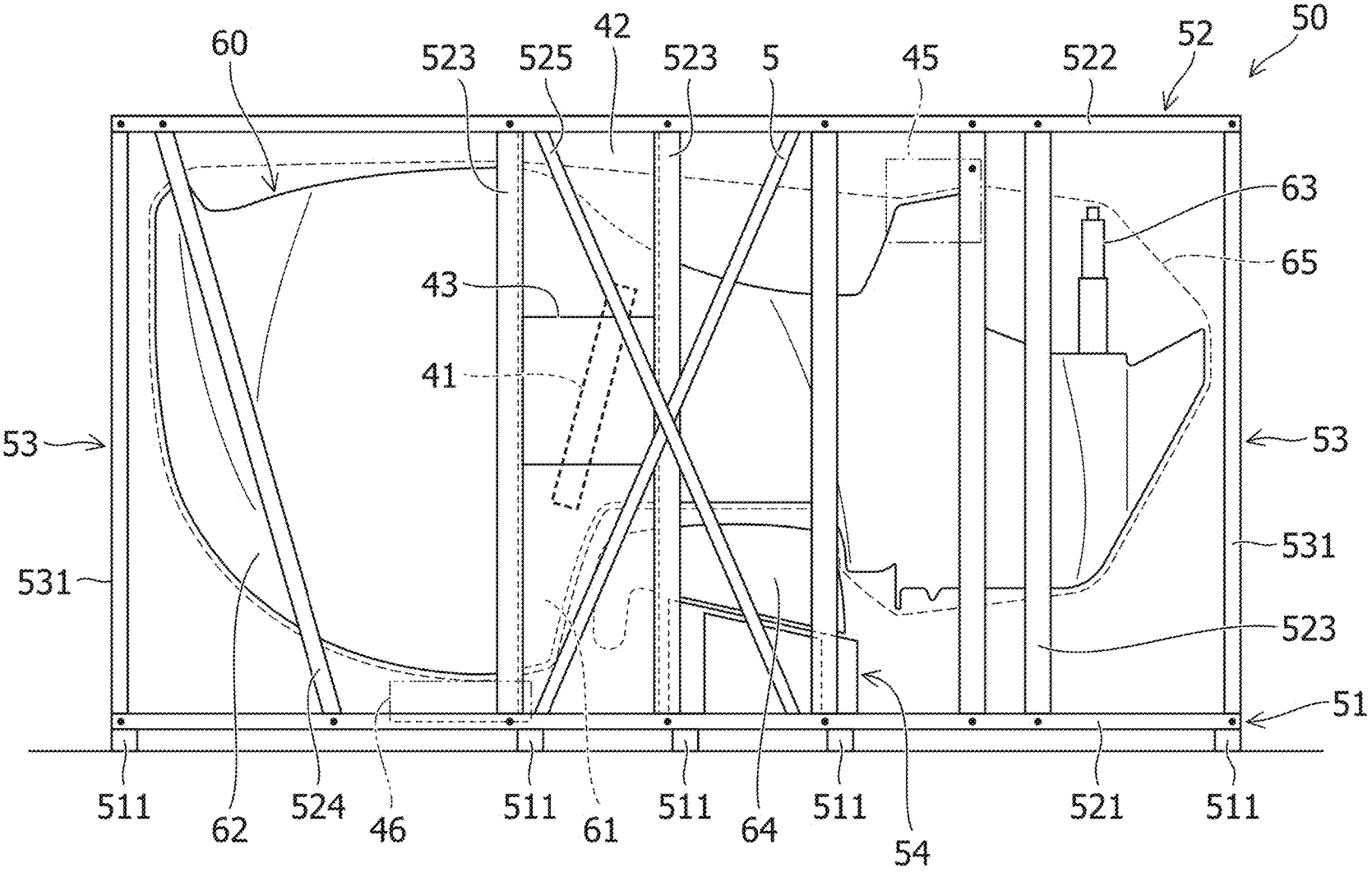
FIG. 1 is a front view illustrating a packing structure for an outboard motor.
Figure 2:
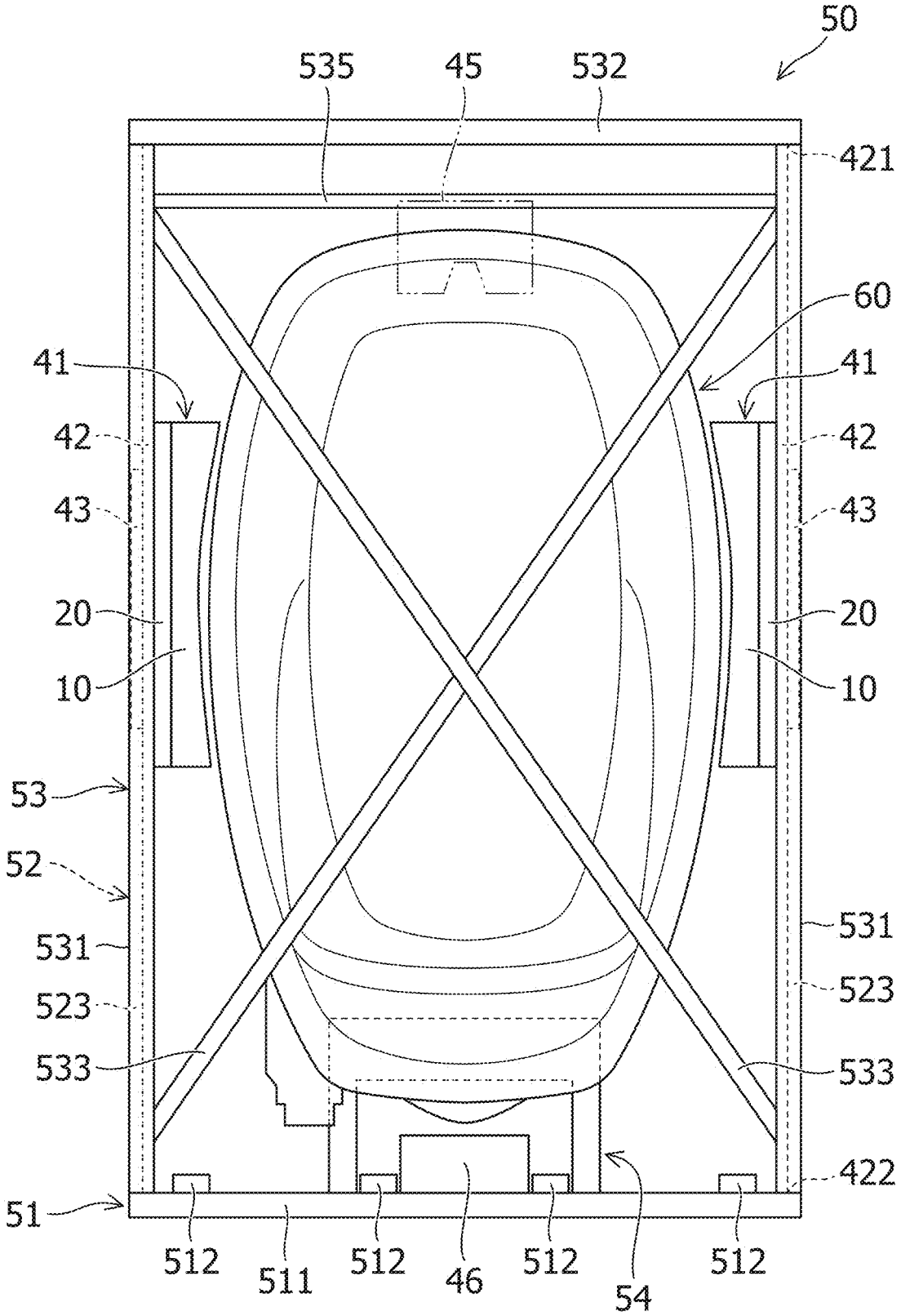
FIG. 2 is a side view illustrating the packing structure for the outboard motor.

FIGS. 1 and 2 illustrate a packing structure in which an outboard motor 60 serving as a packed object is secured and stored in a packing frame 50. The packing frame 50 includes a bottom frame 51 constituting a skid and side frames 52 and end frames 53 that constitute a crate part around the bottom frame 51. A stand 54 is erected nearly at the center of the bottom frame 51.

The outboard motor 60 is secured on a stand 54 in an upright position with its propulsion direction facing downwards by bolting a stern bracket 64 placed on the stand 54. A propeller (not illustrated) has been removed from a propeller shaft 63 and is packed with a sheet 65 (e.g., a plastic film) in this state.

Subsequently, the lower part (521) of the side frame 52 is fixed to each of the long sides of the bottom frame 51 with bolts, the lower end of the end frame 53 is fixed to each of the short sides of the bottom frame 51 with bolts, the side frame 52 and the end frame 53 are joined to each other with bolts, and the upper parts of the opposed side frames 52 are connected via a reinforcing frame (not illustrated), which constitutes the crate part surrounding the outboard motor 60. Thereafter, the packing frame 50 is covered with a corrugated box (not illustrated) from above and is shipped in this state.

The bottom frame 51 is configured as a skid such that five base frames 511 arranged in parallel in the widthwise direction and four longitudinal frames 512 arranged in parallel in the lengthwise direction so as to intersect over the base frames 511 are joined with a base plate, which is not illustrated. The base frames 511 and the longitudinal frames 512 are composed of structural materials such as channel materials. The stand 54 includes leg parts erected adjacent to the joint between the two base frames 511 and the two longitudinal frames 512 near the center, and a top surface part that fits to the stern bracket 64 and has the same inclination as the transom board of a ship such that the crankshaft of the engine is placed in a horizontal position while the outboard motor 60 is secured.

As illustrated in FIG. 1, the side frame 52 is configured such that a lower frame 521 serving as a fixed part on the bottom frame 51 and an upper frame 522 are bolted to the lower and upper end parts of multiple vertical frames 523, respectively, are welded to the ends of a pair of braces 525 welded together at their central intersection, and are rigidly joined without deformation by fastening a brace 524. The lower frame 521, the upper frame 522, and the brace 524 are composed of L-angle structural materials, and the vertical frames 523 are composed of hat-shaped structural materials.

As illustrated in FIG. 2, the end frame 53 is configured such that the upper parts of a pair of vertical frames 531 are joined via an upper frame 532 and are rigidly joined without deformation by welding a pair of braces 533 welded together at their central intersection. The vertical frames 531 and the upper frame 532 are composed of L-angle structural materials. A reinforcing frame 535 is installed between the side frames 52 and serves as a support structure of an upper cushioning member 45.

As described above, the side frames 52 and the end frames 53 surrounding around the outboard motor 60 fixed to the stand 54 on the bottom frame 51 each have a trussed structure that protects the outboard motor 60 and is strong and rigid enough to be stacked when loaded and stored into a container.

However, medium-sized and large-sized outboard motors are 1.5 to 2 m in overall height and 100 to 350 kg in weight and are supported with a large overhang on the stand 54. In addition, the center of gravity is high relative to the supporting position and is biased toward the engine on the left side of FIG. 1. Moreover, as described above, the packing frame 50 is basically a one-way shipping packing material and is designed to have minimum strength and rigidity required for ordinary loading and unloading operations and transportation.

Thus, when an excessive impact is applied to the packing frame 50 by an external factor during loading and unloading operations and transportation, for example, when a carrier vehicle passes through bumps on a road, e.g., speed bumps without deceleration during land transportation, the outboard motor 60 may swing in the packing frame 50 and come into contact with the packing frame 50. In particular, when the packing frame 50 topples over, it is difficult for the stand 54 to cantilever the outboard motor 60, so that the outboard motor 60 may fall onto the inner surface of the packing frame 50.

Thus, in order to prevent the outboard motor 60 from being damaged when in contact with the packing frame 50, cushioning members 41, 45, and 46 that are adjacent to the outboard motor 60 are provided inside the packing frame 50.

Among the cushioning members, the cushioning member 45 is provided for an upward movement around a cavitation plate when a moment occurs counterclockwise in FIG. 1 due to the biased center of gravity of the outboard motor 60 described above. The cushioning member 46 is provided for a downward movement of a top cowl 62. The cushioning member 46 is fixed on the base plate of the bottom frame 51.

In contrast, the cushioning members 41 are disposed adjacent to the sides of the outboard motor 60 inside the side frames 52 in order to reduce lateral swings of the outboard motor 60 in FIG. 2 and an impact when the outboard motor 60 falls due to the toppling over of the packing frame 50. The cushioning members 41 and the mounting structure will be described below with reference to the accompanying drawings.

(Mounting Structure of Cushioning Member 41)

Figure 3A:
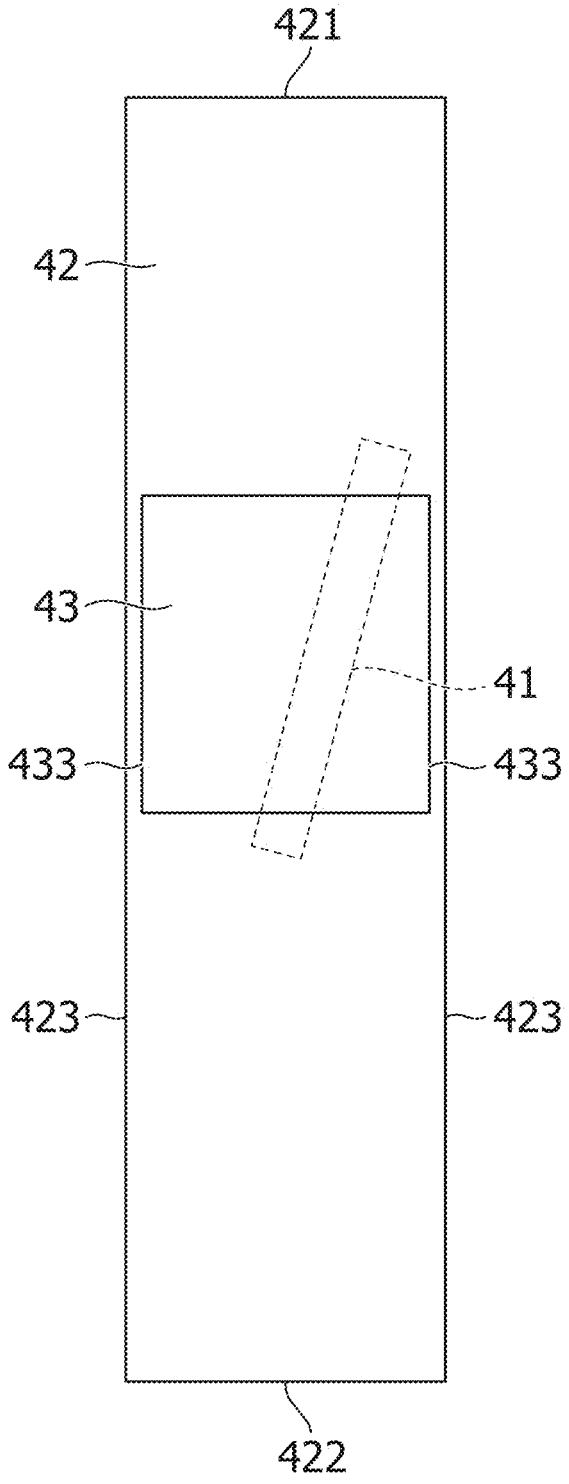
FIG. 3A is a front view illustrating the mounting structure of a cushioning member.
Figure 3B:
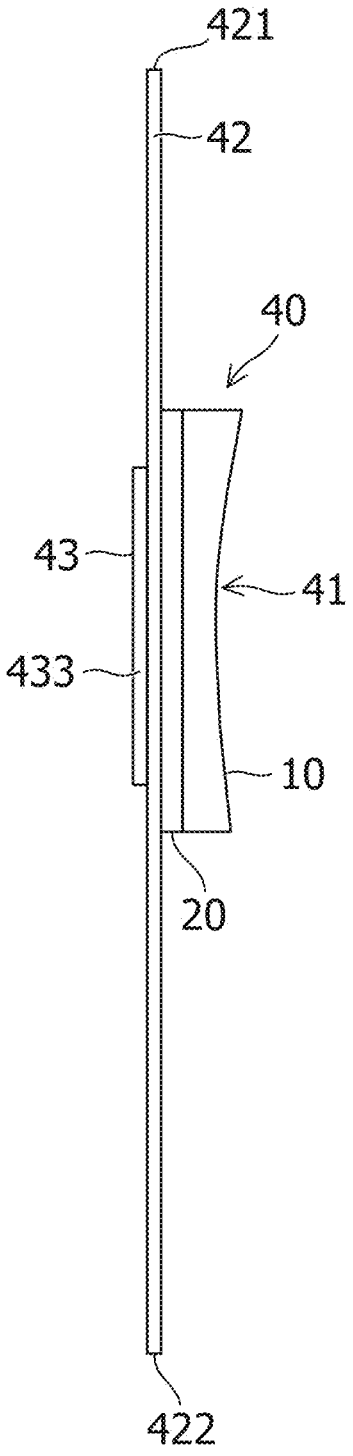
FIG. 3B is a side view illustrating the mounting structure of the cushioning member.

As illustrated in FIGS. 2, 3A, and 3B, the cushioning member 41 includes a first cushioning member 10 having a surface including a curved surface that is formed twodimensionally or three-dimensionally to conform to the shape of the side of the outboard motor 60 near a bottom cowl 61, and a second cushioning member 20 that supports the first cushioning member 10 while being placed in contact with the back side of the first cushioning member 10. The first cushioning member 10 is made of a foam material, and the second cushioning member 20 comprises a corrugated board assembly.

As illustrated in FIG. 1, the cushioning member 41 is joined to the surface of a base part 42 at the bottom of the second cushioning member 20 while being oriented along the shape of the bottom cowl 61 of the outboard motor 60. The base part 42 includes a corrugated cardboard sheet, and an anchor part 43 like a block is joined to the back side of the base part 42. The anchor part 43 includes a laminate of corrugated cardboard sheets, and thus. the base part 42 and the anchor part 43 also have the cushioning function in the thickness direction and constitute a cushioning member assembly 40 with the cushioning member 41.

The cushioning member 41 (cushioning member assembly 40) having such a mounting structure is disposed adjacent to the side of the outboard motor 60 inside the side frame 52 by fitting the anchor part 43 between the two vertical frames 523 such that side edge portions 423 of the base part 42 overlap the inner sides of parts (flange portions) of the two adjacent vertical frames 523 of the side frame 52, and the side edge 433 of the anchor portion 43 is caught between the two vertical frames 523.

The base part 42 has a length corresponding to the length from the upper end to the lower end of the vertical frame 523 in the vertical direction. A lower end 422 of the base part 42 is supported at the inner bottom of the packing frame 50, and an upper end 421 of the base part 42 is in contact with or adjacent to the upper frame 522 in this state. This configuration prevents a displacement of the cushioning members 41 during transportation.

(Assembly Structure of Cushioning Member 41)

An embodiment of the first cushioning member 10 and the second cushioning member 20 that constitute the cushioning member 41 will be described below with reference to the accompanying drawings.

Figure 4:
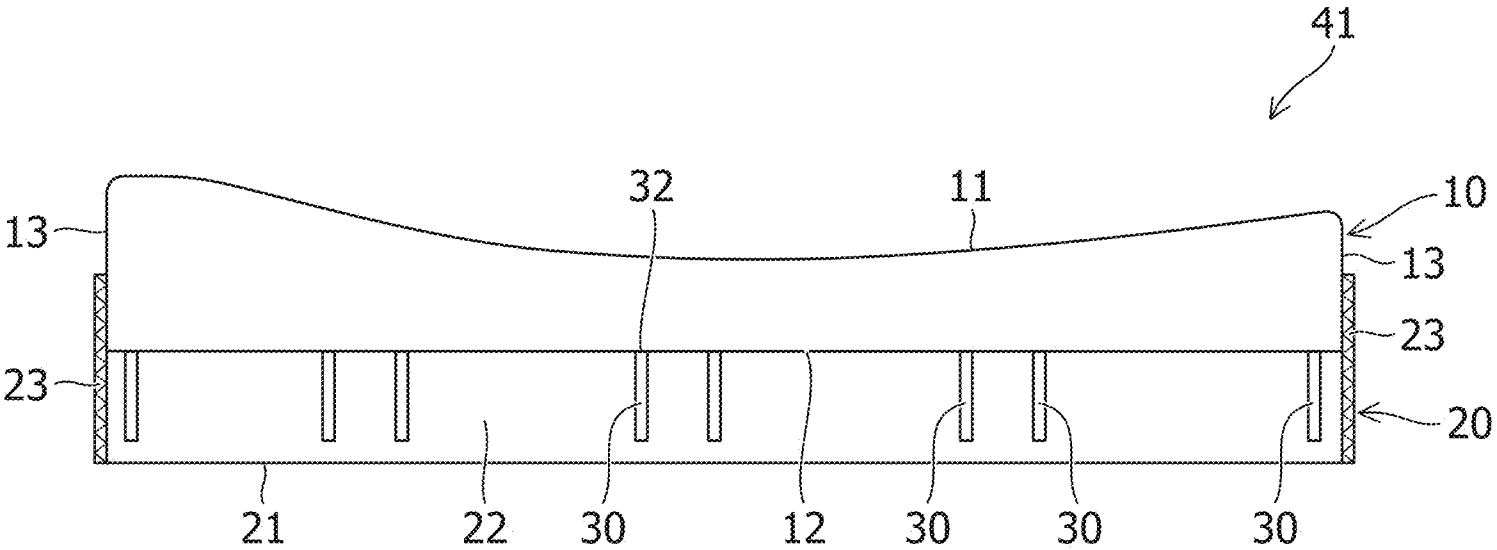
FIG. 4 is a side view illustrating the cushioning member.

As illustrated in FIG. 4, the first cushioning member 10 has a front face 11 including a curved surface conforming to the shape of the side of the outboard motor 60 and a back side 12 having a flat basic shape, and is configured like a long and narrow block extending with a first width w1 in the longitudinal direction. Although a foamed material constituting the first cushioning member 10 is not particularly limited, a foamed material of synthetic resin, e.g., polystyrene foam, may be properly used.

Figure 5A:
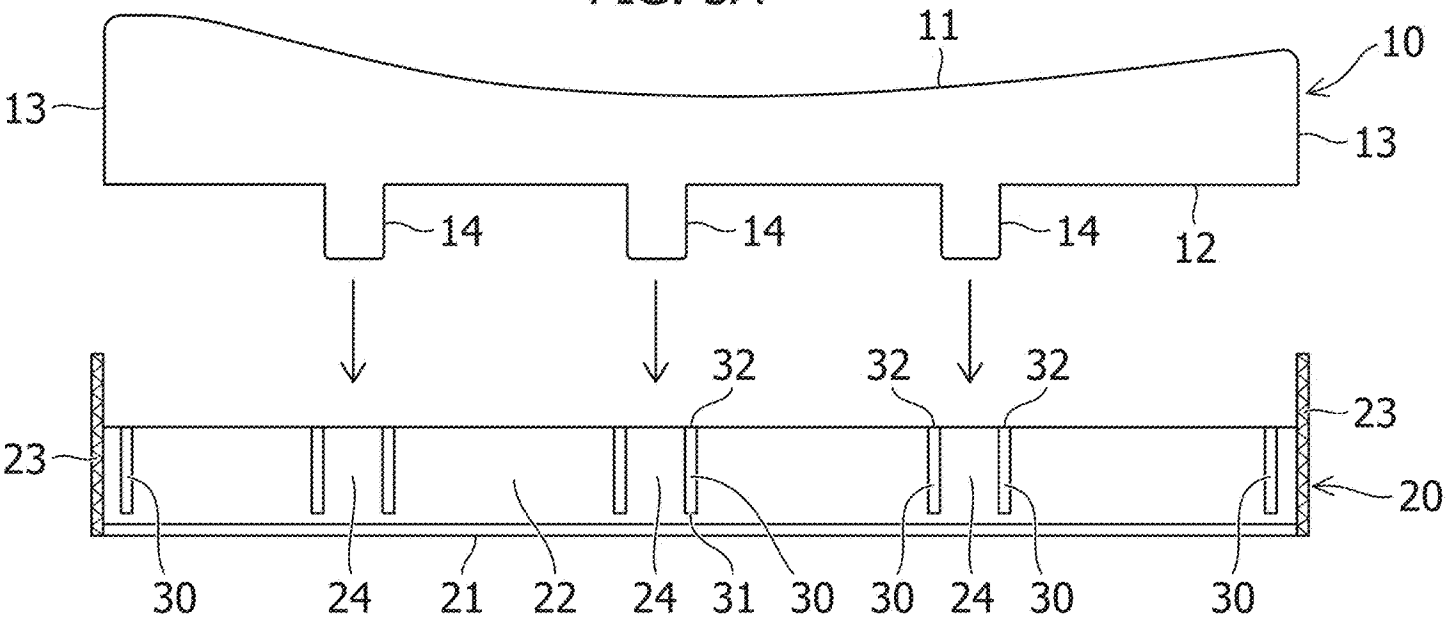
FIG. 5A is a side view illustrating a disassembled state of the cushioning member.
Figure 5B:
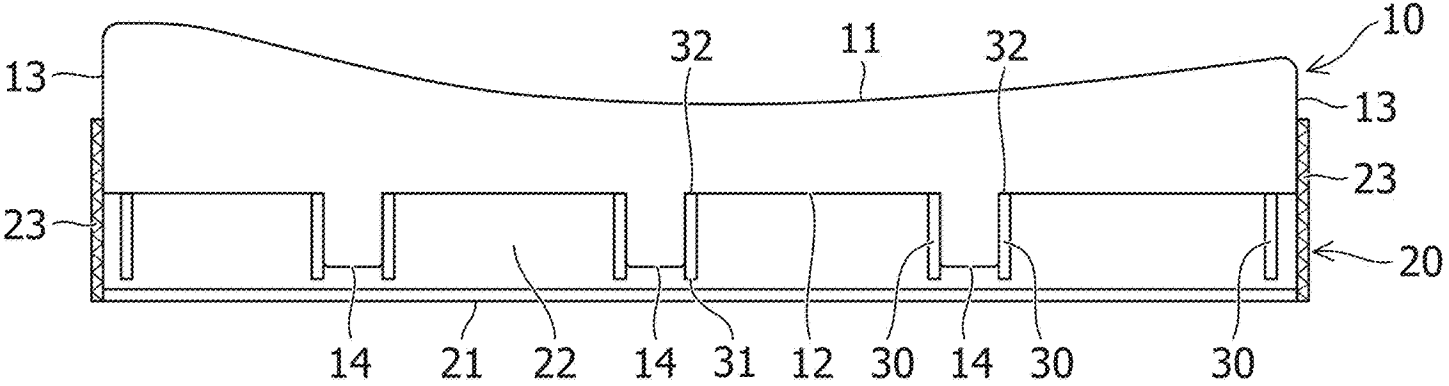
FIG. 5B is a side cross-sectional view illustrating a fit state of the cushioning member.

In a preferred embodiment, as illustrated in FIG. 5A, the first cushioning member 10 has a plurality of leg portions 14 projected at certain intervals on the back side 12 in the longitudinal direction. As illustrated in FIG. 5B, the second cushioning member 20 has a plurality of socket portions 24 formed therein that hold the leg portions 14 of the first cushioning member 10 in a fitted state.

Figure 6A:
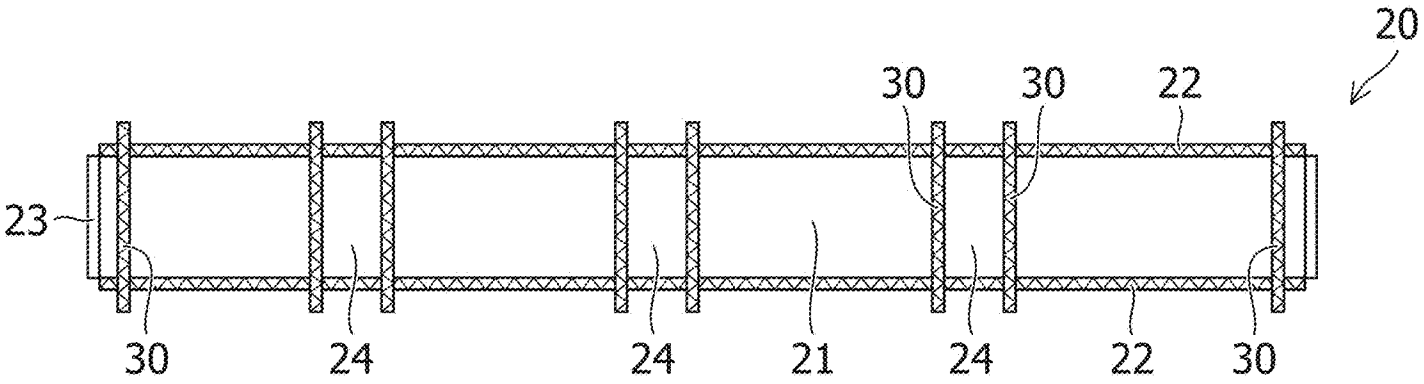
FIG. 6A is a plan view illustrating a second cushioning member.
Figure 6B:
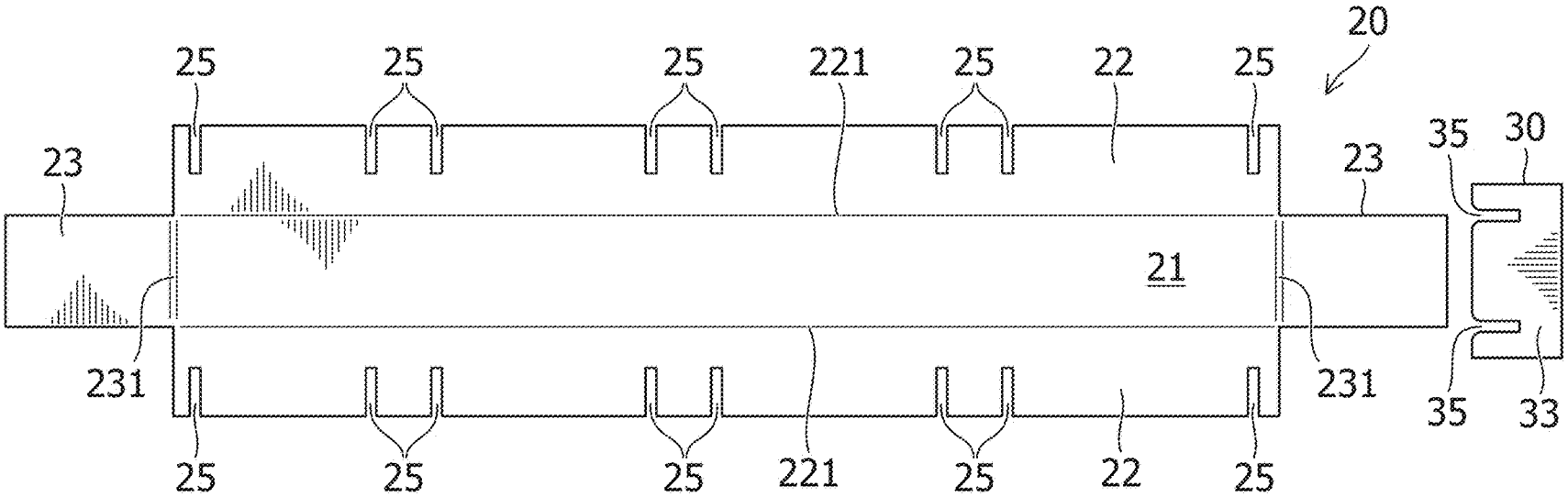
FIG. 6B is a development view illustrating the second cushioning member.

As illustrated in FIG. 6B, the second cushioning member 20 is formed by a corrugated cardboard blank having a bottom wall 21, a pair of side walls 22, and a pair of end flaps 23 such that the width direction orthogonal to the longitudinal direction serves as a flute direction. In other words, folding lines 221 and 231 (creases, scores) are processed on both sides and both ends of the bottom wall 21, and the bottom wall 21 connects to the side walls 22 and the end flaps 23 via the folding lines. On the edges of the side walls 22, slits 25 to be engaged with engagement tabs 33 of bridge portions 30 are provided.

Figure 7:
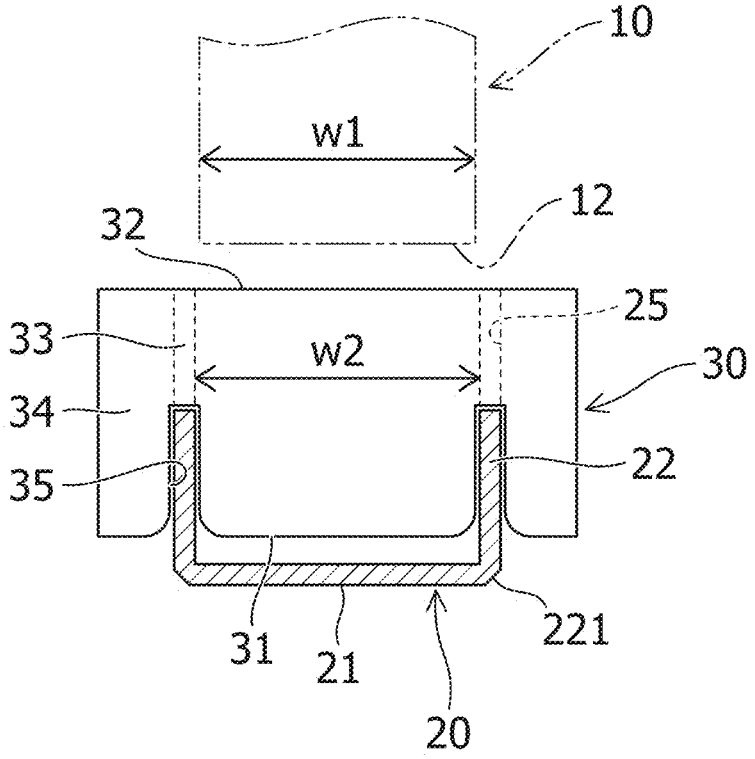
FIG. 7 is a cross-sectional view illustrating the principal part of the cushioning member in a disassembled state.

The plurality of bridge portions 30 are formed by corrugated cardboard blanks identical in shape such that a direction from an upper end 32 to a lower end 31 serves as the flute direction. At positions corresponding to the engagement tabs 33 on both sides of the lower end 31, engagement slots 35 are provided. The engagement slots 35 are engaged with portions under the slits 25 of the side walls 22 toward the engagement tabs 33 near the upper end 32. As illustrated in FIG. 7, extended portions 34 are formed so as to extend laterally through the engagement tabs 33. Furthermore, at an introducing portion on the lower end of the engagement slot 35, an extended opening portion is formed to facilitate engagement with the slit 25.

Thereafter, the folding lines 221 on both sides of the bottom walls 21 are folded, the bottom wall 21 and the pair of side walls 22 on both sides form a channel shape extending in the longitudinal direction with a second width w2, and the engagement slots 35 of the bridge portions 30 are engaged into the respective slits 25 to engage the engagement tabs 33, so that, as illustrated in FIG. 6A, the pair of side walls 22 is bridged by the bridge portions 30 and the adjacent three pairs of the bridge portions 30 and the side walls 22 form the three socket portions 24 that hold the leg portions 14 of the first cushioning member 10.

As illustrated in FIGS. 5 and 7, the engagement tabs 33 of the bridge portion 30 are engaged into the slits 25 of the side walls 22. In this state, a clearance is formed between the lower end 31 of the bridge portion 30 and the bottom wall 21. In other words, the dimensions of the height from the upper end 32 to the lower end 31 of the bridge portion 30 and the depth of the engagement slot 35 (the length of the engagement tab 33 in the engaging direction) are determined so as to form a clearance between the bridge portion 30 and the bottom wall 21 in an engaged state.

As illustrated in FIG. 5, the leg portions 14 of the first cushioning member 10 are inserted and held in the socket portions 24 of the second cushioning member 20 until the upper ends of the bridge portions 30 come into contact with the back side 12 of the first cushioning member 10. In this state, a clearance is formed between the end of the leg portion 14 and the bottom wall 21. In other words, the dimensions of the leg portion 14 are determined such that a clearance is left between the leg portion 14 and the bottom wall 21.

Figure 9A:
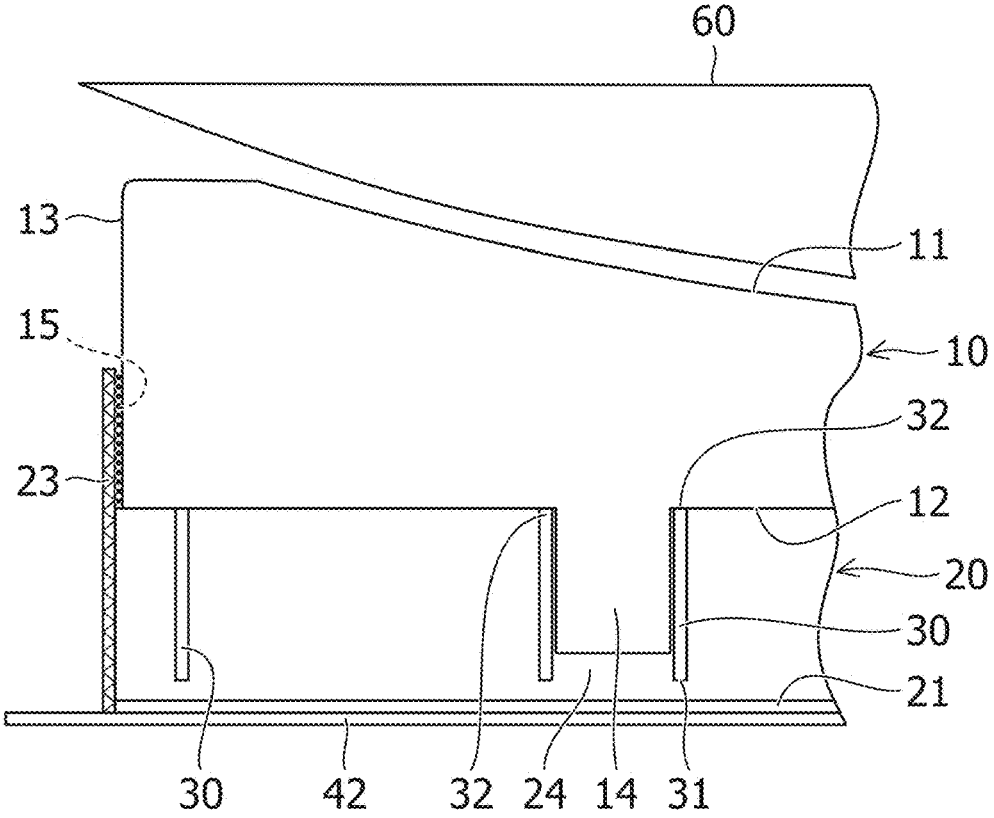
FIG. 9A is a side view illustrating the principal part of the cushioning member.
Figure 9B:
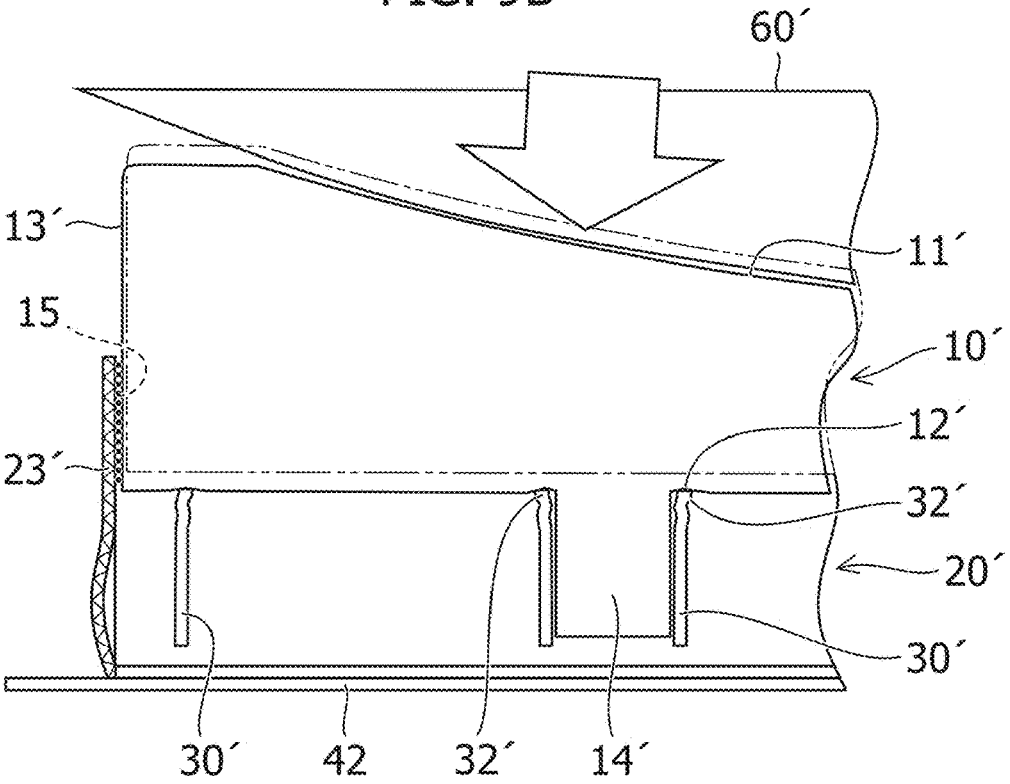
FIG. 9B is a side view illustrating the principal part of the cushioning member in a deformed state.

In this embodiment, the leg portions 14 of the first cushioning member 10 are held in the socket portions 24 of the second cushioning member 20, so that the first cushioning member 10 and the second cushioning member 20 are integrated. Thus, no other joining or engagement is required between the first cushioning member 10 and the second cushioning member 20. As illustrated in FIG. 9A, the end flap 23 of the second cushioning member 20 may be joined 15 on an end face 13 of the first cushioning member 10. The end flap 23 is oriented with the flute direction in the width direction, and thus can be easily deformed in the height direction as illustrated in FIG. 9B. The end flap 23 does not interfere with elastic deformation of the first cushioning member 10 and plastic deformation of the second cushioning member 20 (bridge portions 30).

(Impact Absorbing Effect of Cushioning Member 41)

Figure 8:
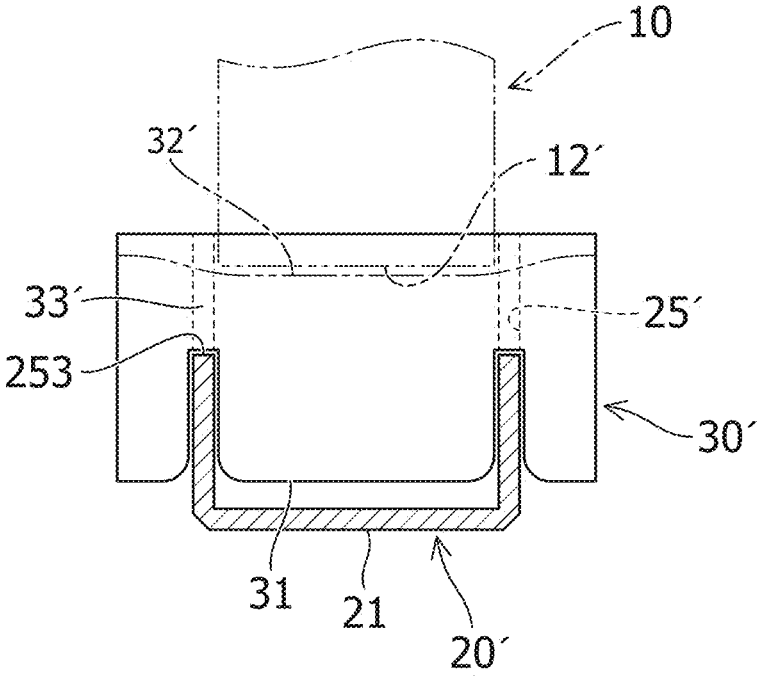
FIG. 8 is a cross-sectional view illustrating the principal part of the cushioning member in a deformed state.

As described above, the cushioning member 41 (cushioning member assembly 40) including the first cushioning member 10 made of a foam material and the second cushioning member 20 including a corrugated board assembly is disposed adjacent to one side of the outboard motor 60 inside the side frame 52 of the packing frame 50. With this configuration, when the packing frame 50 falls sideways and the outboard motor 60 falls laterally in the packing frame 50 due to an external factor during transportation of the outboard motor 60 (packing frame 50) or loading and unloading operations, as illustrated in FIGS. 8 and 9B, the first cushioning member 10 and the second cushioning member 20 are located under an outboard motor 60', so that an impact load from the outboard motor 60' is applied to a front face 11' of a first cushioning member 10', the first cushioning member 10' is pressed downward while being partially subjected to elastic deformation, and bridge portions 30' of a second cushioning member 20' are plastically deformed from an upper end 32' (first step).

Furthermore, engagement tabs 33' of the bridge portions 30' and slits 25' and slit bottoms 253 of the side walls 22 are plastically deformed, and the bridge portions 30' are moved downward. Thus, before the bridge portions 30' are crushed, leg portions 14' of the first cushioning member 10' are placed onto the bottom wall 21 of the second cushioning member 20, the elastic deformation of the leg portions 14' is started, and the bridge portions 30' are plastically deformed at the same time (second step).

Thereafter, the bridge portions 30' of the second cushioning member 20 are crushed by the load of the outboard motor 60', and the body and the leg portions 14' of the first cushioning member 10' are elastically and partially plastically compressed to receive the static load of the outboard motor 60'. In this state, the falling of the outboard motor 60' is ended (third step).

In reality, the foregoing process is terminated nearly instantly. The elastic deformation of the first cushioning member 10 made of a foam material and the plastic deformation of the second cushioning member 20 including a corrugated board assembly have different deformation patterns, the elastic compression of the first cushioning member 10 is delayed by, in particular, the plastic deformation of the second cushioning member 20, and the plastic deformation of the second cushioning member 20 is decelerated. Such synergistic action can avoid breakage of the first cushioning member 10 and maximize an impact absorbing effect obtained by the elastic deformation of the first cushioning member 10 and the plastic deformation of the second cushioning member 20, thereby advantageously preventing damage to the outboard motor 60.

In the foregoing process, the first cushioning member 10 enters a channel shape defined between the side walls 22 of the second cushioning member 20, and the sides of the first cushioning member 10 are guided by the side walls 22. In addition, the leg portions 14 of the first cushioning member 10 are guided by the socket portions 24, each being formed between the bridge portions 30 of the second cushioning member 20. Thus, a displacement between the first cushioning member 10 and the second cushioning member 20 is prevented, the elastic deformation of the body and the leg portions 14 of the first cushioning member 10 is securely induced between the side walls 22 of the second cushioning member 20, and an impact load applied to the first cushioning member 10 is securely input to the bridge portions 30 of the second cushioning member 20, thereby obtaining an impact absorbing effect according to the design.

Second Embodiment

Figure 10A:
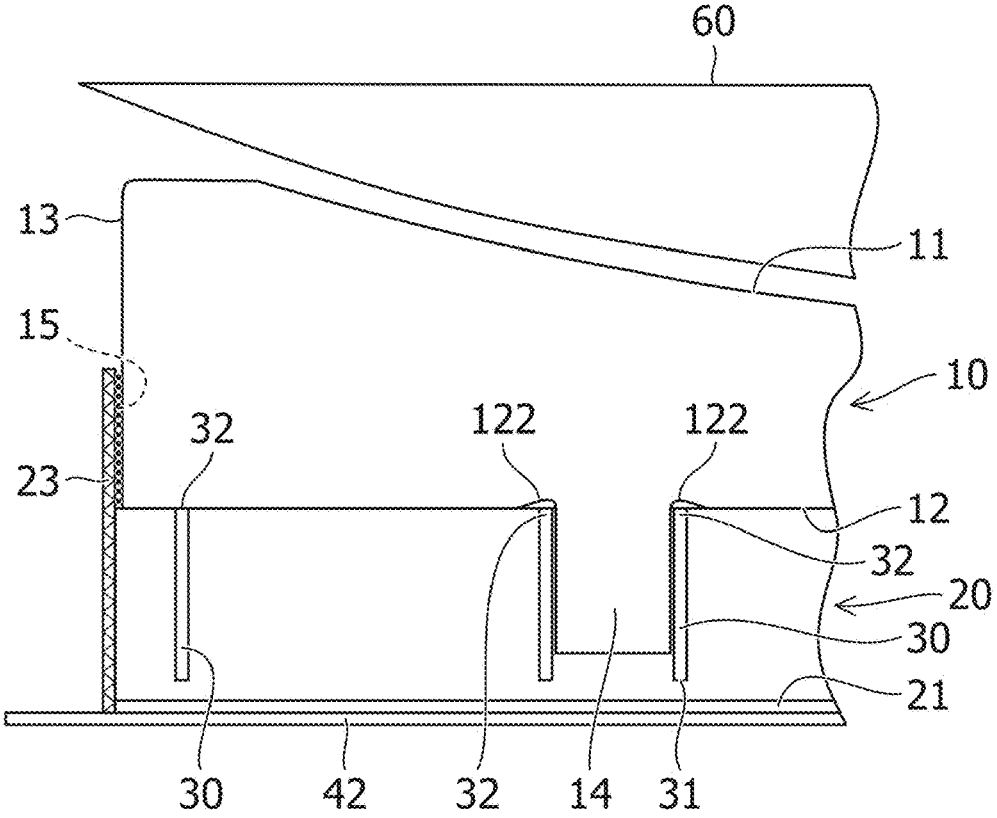
FIG. 10A is a side view illustrating the principal part of a cushioning member according to a second embodiment.
Figure 10B:
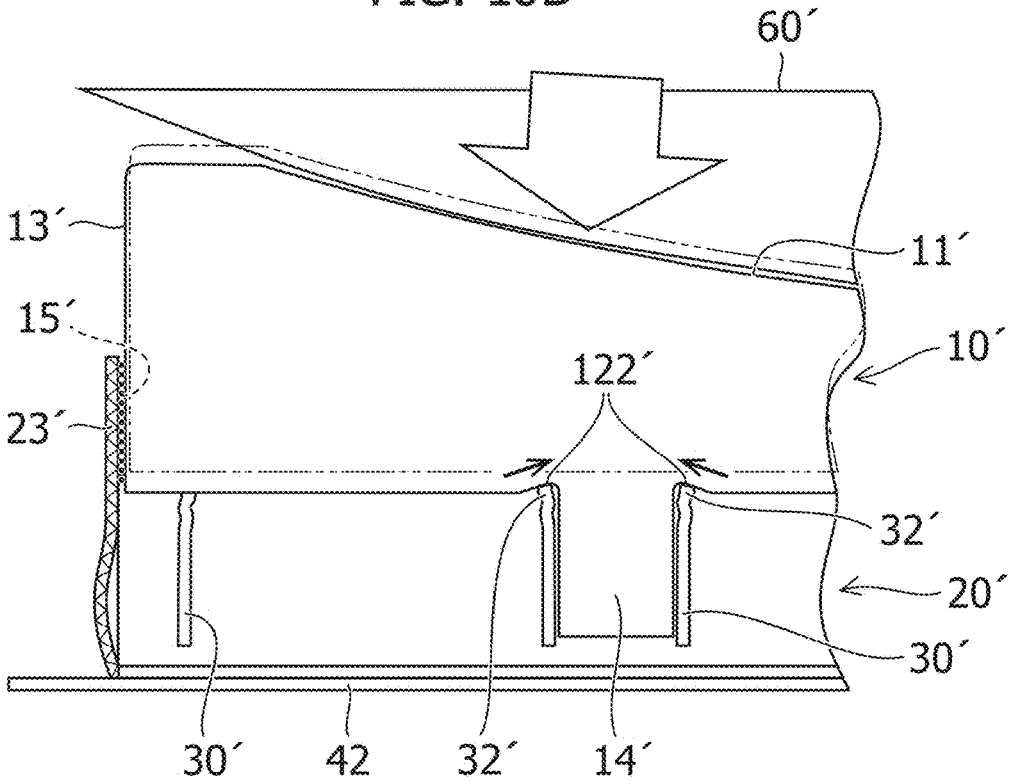
FIG. 10B is a side view illustrating the principal part of the cushioning member in a deformed state according to the second embodiment.

FIGS. 10A and 10B illustrate a cushioning member 41 according to a second embodiment, in which recess portions 122 extending in the width direction are formed on a back side 12 adjacent to a leg portion 14 of a first cushioning member 10.

The recess portion 122 formed thus defines a gap between the back side 12 of the first cushioning member 10 and an upper end 32 of a bridge portion 30 of a second cushioning member 20 in a natural state. When an impact load is applied to the first cushioning member 10, upper ends 32' of bridge portions 30' are brought into recess portions 122', the plastic deformation of the bridge portions 30 is induced with the upper ends 32' located adjacent to the proximal part of the leg portion 14, and irregular deformation or breakage of the bridge portions 30 is suppressed, thereby advantageously obtaining the impact absorbing effect according to the design.

For the same reason, the recess portion 122 preferably has a slope that decreases in depth according to a distance from the leg portion 14. With this configuration, as illustrated in FIG. 10B, the upper end 32' of the bridge portion 30' is securely guided to a position adjacent to the proximal part of the leg portion 14 in the recess portion 122', thereby more advantageously obtaining the impact absorbing effect according to the design.

As described above, the recess portion 122 is designed to guide the upper end 32' of the bridge portion 30' to a position adjacent to the proximal part of the leg portion 14 in an initial stage, and thus, the recess portion 122 is basically formed into a small recess with a maximum depth less than a gap between the lower end of the leg portion 14 of the first cushioning member 10 and a bottom wall 21 of the second cushioning member 20.

Main Configuration and Effects

The cushioning member according to the present invention has the following characteristics and effects.

(1) In a basic aspect, a cushioning member (41) disposed inside a side (52) of a packing frame (50) surrounding a packed object (60), the cushioning member (41) being provided to protect the packed object (60) secured on an inner bottom (51, 54) of the packing frame (50), the cushioning member (41) including: a first cushioning member (10) that has a front face (11) disposed adjacent to the packed object (60) and a back side (12) opposite to the front face; and a second cushioning member (20) that has an upper end (32) in contact with the back side of the first cushioning member and a bottom (21) disposed near the side of the packing frame, wherein the first cushioning member (10) is made of a foam material, and the second cushioning member (20) includes a corrugated board assembly.

With this configuration, when a large impact is applied by an external factor, an impact load applied from the packed object to the cushioning member is reduced by elastic deformation of the first cushioning member made of a foam material and is absorbed by plastic deformation of the second cushioning member including a corrugated board assembly, and breakage of the first cushioning member, in particular, breakage in the initial stage is reduced, thereby obtaining an excellent cushioning effect.

In addition, as compared with a case in which a cushioning member is entirely made of a foam material, the present invention has the advantage of reducing the amount of foam material used, which is industrial waste after use.

(2) In a preferred aspect, the first cushioning member (10) includes a body extending with a first width (w1) in the longitudinal direction and a plurality of leg portions (14) projected at certain intervals on the back side (12) of the body in the longitudinal direction, the second cushioning member (20) has a bottom wall (21) extending in the longitudinal direction, a pair of side walls (22) connected on both sides of the bottom wall via folding portions (221), and a plurality of bridge portions (30) that bridge the pair of side walls at multiple points spaced in the longitudinal direction such that the bottom wall and the side walls form a channel extending in the longitudinal direction with a second width (w2) larger than the first width, and two adjacent ones of the plurality of bridge portions and the pair of side walls form a socket portion (24) that holds the leg portion (14) in a state in which the upper ends (32) of the bridge portions are in contact with the back side (12) of the first cushioning member.

With this configuration, a displacement between the first cushioning member and the second cushioning member is reduced when an impact load is applied, the elastic deformation of the first cushioning member is securely induced between the pair of side walls, and the plastic deformation of the bridge portions is securely induced between the pair of side walls. Additionally, the plastic deformation of the bridge portions and the elastic deformation of the leg portions are guided in the initial stage. Thus, such synergistic action can maximize an impact absorbing effect.

(3) Moreover, in a preferred aspect, a clearance is formed between the end of the leg portion (14) and the bottom wall (21) in a state in which the upper ends (32) of the bridge portions (30) are in contact with the back side (12) of the first cushioning member (10). With this configuration, the elastic deformation of the leg portions is delayed and the plastic deformation of the bridge portions is induced in the initial stage, thereby avoiding breakage of the first cushioning member and maximizing the impact absorbing effect through synergistic action.

The embodiments of the present invention were described in the foregoing description. The present invention is not limited to the embodiments and can be modified and changed in various ways within the scope of the present invention.

For example, in the case of the foregoing embodiments, the three leg portions 14 are formed on the back side 12 of the first cushioning member 10. The number of leg portions 14 may be two or four or more. Moreover, if a clearance between the end of the leg portion 14 and the bottom wall 21 is too large, the amount of elastic deformation of the leg portion 14 decreases accordingly. Thus, the clearance is equal to or smaller than a half of the depth of the socket portion 24 or is preferably equal to or is smaller than one third of the depth of the socket portion 24.

Furthermore, in the foregoing embodiments, the width of the leg portion 14 in the longitudinal direction of the first cushioning member 10 is one fourth of the space of a section having no leg portions, that is, the ratio of the leg portion and the space is, but is not limited to, 1 to 4. Moreover, in the illustrated example, a leg portion (foam material portion) may be added to a section having no leg portions. However, if the ratio of the space is too large, the leg portion may have insufficient elasticity. Conversely, when the ratio of the leg portion (foam material portion) is too large, the amount of foam material used increases accordingly, and also the ratio of elastic deformation increases in the step of developing plastic deformation and elastic deformation in parallel (second step), so that the contribution ratio of the cushioning effect obtained by the plastic deformation of the bridge portions may decrease.

Moreover, the back side 12 of the first cushioning member 10 may be flattened without providing the leg portions 14 on the back side 12 of the first cushioning member 10. In this case, as illustrated in FIG. 9A, the end flap 23 of the second cushioning member 20 has the joint 15 on the end face 13 of the first cushioning member 10, so that the first cushioning member 10 can be held by the second cushioning member 20.

In the foregoing embodiments, the upper ends 32 of the bridge portions 30 of the second cushioning member 20 are aligned with the upper ends of the side walls 22. The upper ends of the side walls 22 may protrude upward from the upper ends 32 of the bridge portions 30. Such a protrusion does not contribute to reduction in manufacturing cost, but advantageously yields the effect of guiding the first cushioning member 10 into the channel of the second cushioning member 20 to prevent displacement in the embodiment not including the leg portions 14.

In the foregoing embodiments, the cushioning member 41 is inclined along the bottom cowl 61, which is a high-strength part of the outboard motor 60, and is located midway between the vertical frames 523. The cushioning member 41 may be located inside the vertical frame 523 near the top cowl 62 on the left side of FIG. 1 or may be added. In this case, the cushioning member 41 may be directly fixed to the inside of the vertical frame 523 without the base part 42.

In the foregoing embodiments, the outboard motor 60 is a packed object. The cushioning members 41 according to the present invention can also be implemented when another packed object, e.g., a motorcycle, is transported with insufficient self-support like an outboard motor while being secured in an upright position in the packing frame.

REFERENCE SIGNS LIST

10 First cushioning member (foam material)
11 Front face
12 Back side
14 Leg portion
20 Second cushioning member (corrugated board assembly)
21 Bottom wall
22 Side wall
24 Socket
25 Slit
30 Bridge portion
31 Lower end
32 Upper end
33 Engagement tab
35 Engagement slot
60 Outboard motor (packed object)
50 Packing frame
51 Bottom frame
52 Side frame
53 End frame
54 Stand

The invention claimed is:

1. A cushioning member disposed inside a side of a packing frame surrounding a packed object, the cushioning member being provided to protect the packed object secured on an inner bottom of the packing frame, the cushioning member comprising:

a first cushioning member that has a front face disposed adjacent to the packed object and a back side opposite to the front face; and a second cushioning member that has an upper end in contact with the back side of the first cushioning member and a bottom disposed near the side of the packing frame, wherein the first cushioning member is made of a foam material, and the second cushioning member comprises a corrugated board assembly, wherein the first cushioning member comprises a body that has the front face and the back side and extends in a longitudinal direction with a first width and a plurality of leg portions projected on the back side of the body at intervals in the longitudinal direction, the second cushioning member has a bottom wall extending in the longitudinal direction, a pair of side walls connected on both sides of the bottom wall via folding portions, and a plurality of bridge portions that bridge the pair of side walls at multiple points spaced in the longitudinal direction such that the bottom wall and the side walls form a channel extending in the longitudinal direction with a second width larger than the first width, and two adjacent ones of the plurality of bridge portions and the pair of side walls form a socket portion that holds one of the leg portions in a state in which upper ends of the bridge portions are in contact with the back side of the first cushioning member.

2. The cushioning member according to claim 1, wherein a clearance is formed between an end of the one of the leg portions and the bottom wall in a state in which the upper ends of the bridge portions are in contact with the back side of the first cushioning member.

3. The cushioning member according to claim 2, wherein the leg portions of the first cushioning member are provided in an intermediate part other than the two ends of the body in the longitudinal direction, and the body of the first cushioning member has recess portions each extending in a width direction on the back side adjacent to the one of the leg portions such that each of the recess portions defines a gap between the back side and the upper end of the bridge portion.

4. The cushioning member according to claim 3, wherein each of the recess portions has a slope that decreases in depth as a distance from the one of the leg portions increases.

5. The cushioning member according to claim 4, wherein each of the recess portions has a maximum depth smaller than the clearance between the end of the one of the leg portions and the bottom wall.

6. The cushioning member according to claim 1, wherein each of the bridge portions has a pair of engaging portions that are engaged with the pair of side walls to bridge the pair of side walls, and each of the engaging portions includes an engagement tab extending laterally to be engaged into a slit extending from an upper end of the side wall toward the bottom wall.

7. The cushioning member according to claim 6, wherein the engagement tab of each of the bridge portions further includes an extended portion that is extended over the slit so as to form an engagement slot to be engaged with a portion under the slit of the side wall.

8. The cushioning member according to claim 1, wherein the bottom wall and the pair of side walls of the second cushioning member are formed by a first corrugated cardboard blank such that a flute direction of the first corrugated cardboard blank is orthogonal to the longitudinal direction, and the plurality of bridge portions are formed by a plurality of second corrugated cardboard blanks such that a direction from the upper end to a lower end serves as a flute direction.

* * * * *